US012188202B2

(12) United States Patent
Austin

(10) Patent No.: US 12,188,202 B2
(45) Date of Patent: Jan. 7, 2025

(54) WALKING SYSTEM WITH REPLACEABLE WEAR SURFACES

(71) Applicant: Caterpillar Global Mining LLC, Tucson, AZ (US)

(72) Inventor: David S. Austin, Racine, WI (US)

(73) Assignee: Caterpillar Global Mining LLC, Tucson, AZ (US)

( * ) Notice: Subject to any disclaimer, the term of this patent is extended or adjusted under 35 U.S.C. 154(b) by 713 days.

(21) Appl. No.: 17/409,280

(22) Filed: Aug. 23, 2021

(65) Prior Publication Data

US 2023/0053466 A1 Feb. 23, 2023

(51) Int. Cl.
*E02F 9/04* (2006.01)
*E02F 9/12* (2006.01)

(52) U.S. Cl.
CPC ..... *E02F 9/121* (2013.01); *E02F 9/04* (2013.01)

(58) Field of Classification Search
CPC ... B66C 9/14; B62D 57/00; E02F 3/48; E02F 9/04; E02F 9/121
See application file for complete search history.

(56) References Cited

U.S. PATENT DOCUMENTS

| | | | | |
|---|---|---|---|---|
| 3,500,945 A * | 3/1970 | Furey | B62D 57/00 180/8.5 |
| 3,901,341 A * | 8/1975 | Stoldt | E02F 9/04 180/8.5 |
| 4,252,204 A * | 2/1981 | Bishop | E02F 9/04 180/8.5 |
| 4,329,795 A | 5/1982 | Kalve | |
| 4,611,440 A | 9/1986 | Kalve | |
| 5,040,314 A | 8/1991 | Kalve | |
| 5,941,326 A * | 8/1999 | Fleuchaus | B62D 55/0847 180/9.1 |
| 7,204,519 B2 | 4/2007 | Kubo | |
| 7,997,619 B2 | 8/2011 | Sugimoto | |

FOREIGN PATENT DOCUMENTS

EP 0185531 A1 6/1986

* cited by examiner

*Primary Examiner* — Thomas B Will
*Assistant Examiner* — Robert E Pezzuto

(57) ABSTRACT

A cam frame assembly for a walking system includes a plurality of frame components. The frame components include an upper frame, a lower frame, a front guide frame, and a rear guide frame. At least one of the frame components includes a replaceable wear surface. The replaceable wear surface is an insert retained within a notch in the frame component.

20 Claims, 14 Drawing Sheets

WALKING SYSTEM WITH REPLACEABLE WEAR SURFACES

TECHNICAL FIELD

The present disclosure relates generally to dragline excavators, and more specifically to walking systems for dragline excavators.

BACKGROUND

The open mining industry utilizes a variety of very large excavating machines. One type of these excavators is a dragline. Draglines are known to have booms of over 100 meters and weigh tens of thousands of tons. When these oversized machines need to move short distances, traditional traction devices such as wheels and tracks are not effective. Instead, these machines utilize a walking mechanism, one embodiment of which is described in U.S. Pat. No. 1,591,764 to Martinson.

The walking mechanism includes an eccentric cam mounted in a cam frame assembly which lifts a shoe platform and the dragline in turn to allow a slow walking movement. The contact surfaces of the cam frame are prone to wear due to the intense load of this movement. However, replacement of the entirety of a cam frame is expensive. Therefore, there is a need for a cam frame assembly with a longer lifespan.

SUMMARY OF THE DISCLOSURE

According to one aspect of the present disclosure, a cam frame assembly for a walking system is disclosed. The cam frame assembly includes a plurality of frame components. The frame components include an upper frame, a lower frame, a front guide frame, and a rear guide frame. At least one of the frame components includes a replaceable wear surface. The replaceable wear surface is an insert retained within a notch in the frame component.

According to another aspect of the present disclosure, a walking system is disclosed. The walking system includes a motor, a shaft driven by the motor, an eccentric cam mounted to the shaft on a first side and having a cam post extending from a second side, a cam frame assembly configured to follow the cam, and a shoe platform attached to the cam frame assembly. The cam frame assembly has a plurality of frame components and at least one of the frame components has a trapezoidal notch and an insert configured to fit within the notch.

According to yet another aspect of the present disclosure, a dragline is disclosed. The dragline includes a body, a base assembly supporting the body, a boom assembly supported by the body, a bucket assembly supported by the boom assembly, and a walking system configured to move the dragline. The walking system has a motor, a shaft driven by the motor and extending into the body, an eccentric cam mounted to the end of the shaft on an inner surface of the cam, and a cam frame assembly configured to follow the cam. The cam has a cam post with a roller extending from an outer surface of the cam. The cam frame assembly has a plurality of frame components. At least one of the frame components has a replaceable wear surface.

These and other aspects of the present disclosure will be more readily understood after reading the following detailed description in conjunction with the accompanying drawings.

DETAILED DESCRIPTION

Figure 1:
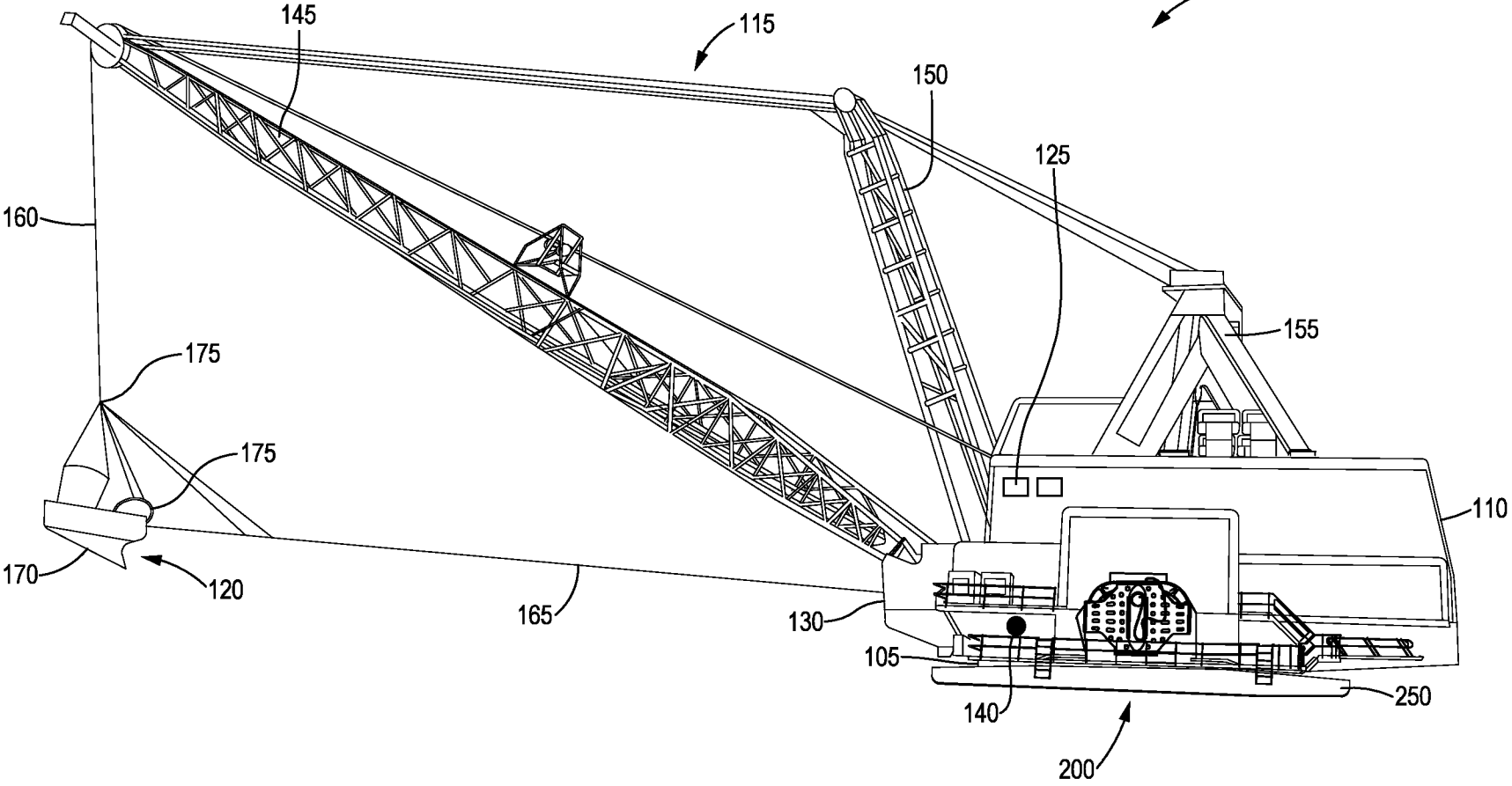
FIG. 1 is a side view of a dragline, according to one aspect of the present disclosure.

Reference will now be made in detail to specific embodiments or features, examples of which are illustrated in the accompanying drawings. Wherever possible, corresponding or similar reference numbers will be used throughout the drawings to refer to the same or corresponding parts.

Draglines, also referred to as dragline excavators, are a type of heavy equipment used in surface mining. Referring now to the drawings and with specific reference to FIGS. 1, an exemplary dragline is shown and referred to by reference numeral 100. The dragline 100 includes a base assembly 105, a main body 110, a boom assembly 115, and a bucket assembly 120.

The base assembly 105 supports the body 110 in a stable and level position during operation. The body 110 includes a house 125 and a revolving frame rotatably mounted to the base assembly 105. Within the body 110 are housed an operator station and various systems (not shown) for operation of the dragline 100, which may include a swing mechanism to drive the rotation of the body 110, a hoist/drag system to manipulate the bucket assembly 120, and electric drive systems powering the mechanisms. The boom assembly 115 is mounted on a front end 130 of the body 110 and extends outward along a longitudinal axis 135 of the body 110 (see FIG. 2). The weight of the body 110 is distributed to counterbalance the boom assembly 115 and a center of mass 140 (see FIG. 2) of the dragline 100 is located towards the front end 130 of the body 110.

The boom assembly 115 includes a main boom 145 and may include a mast 150 and an a-frame 155. Suspension cables connect between the mast 150 and the boom 145 and between the mast 150 and the a-frame 155. The suspension cables provide support for the main boom 145. The boom assembly 115 supports the bucket assembly 120 which includes hoist lines 160, drag lines 165, a bucket 170, and various coupling assemblies 175. In operation, the bucket 170 is lowered from the main boom 145 by the hoist lines 160 and collects material from the ground as it is pulled back towards the body 110 of the dragline 100 by the drag lines 165. In some embodiments, the main boom 140 may have a length of over 100 meters, and the bucket 170 may have a capacity of 30-150 cubic meters.

Figure 2:
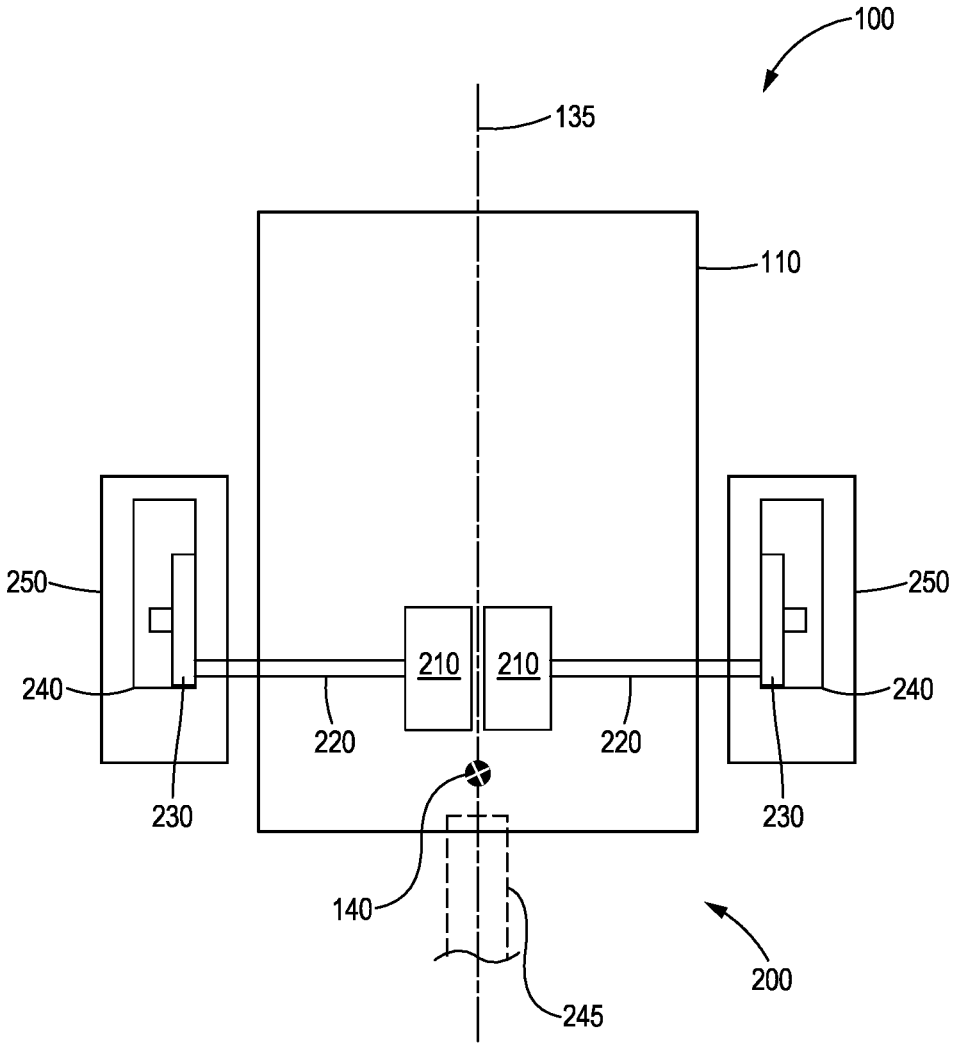
FIG. 2 is a block diagram of a walking system for the dragline of FIG. 1, according to one aspect of the present disclosure.

Some of these dragline excavators 100 are so heavy (up to 10,000 tons) that traditional movement devices such as wheels or tracks will not effectively function. Instead, such draglines 100 may utilize a walking system 200, sometimes known as a Monighan walking mechanism. The walking system 200, depicted in FIG. 2, is duplicated on each side of the dragline and includes a motor 210 driving a shaft 220, an eccentric cam 230 attached to the end of the shaft 220, a cam frame assembly 240 following the movement of each cam 230, and a shoe platform 250 attached to each cam frame assembly 240.

The motor 210 may be an electric motor and may be connected to the shaft via a bull gear and/or parallel shaft gear box (not shown). The electric motor may be either a DC motor or an AC induction motor.

The shaft 220 extends through the body 110 of the dragline 100 perpendicular to the longitudinal axis 135 of the dragline 100 and behind the center of mass 140 of the dragline 100. In some embodiments, the shaft 220 may be continuous, while in other embodiments, separate shafts may independently drive each side of the walking system 220. If separate shafts 220 are utilized, they may be electronically synchronized by a control system (not shown). Each end of the shaft 220 is connected to an inner surface 255 (FIG. 4) of the eccentric cam 240.

Figure 3:
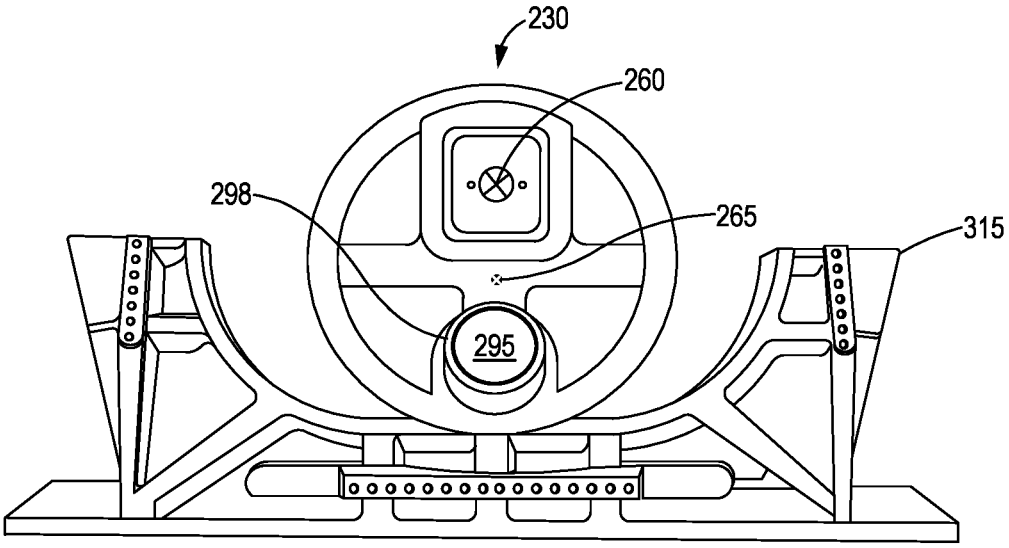
FIG. 3 is a front view of a cam for the dragline of FIG. 1, according to one aspect of the present disclosure.
Figure 4:
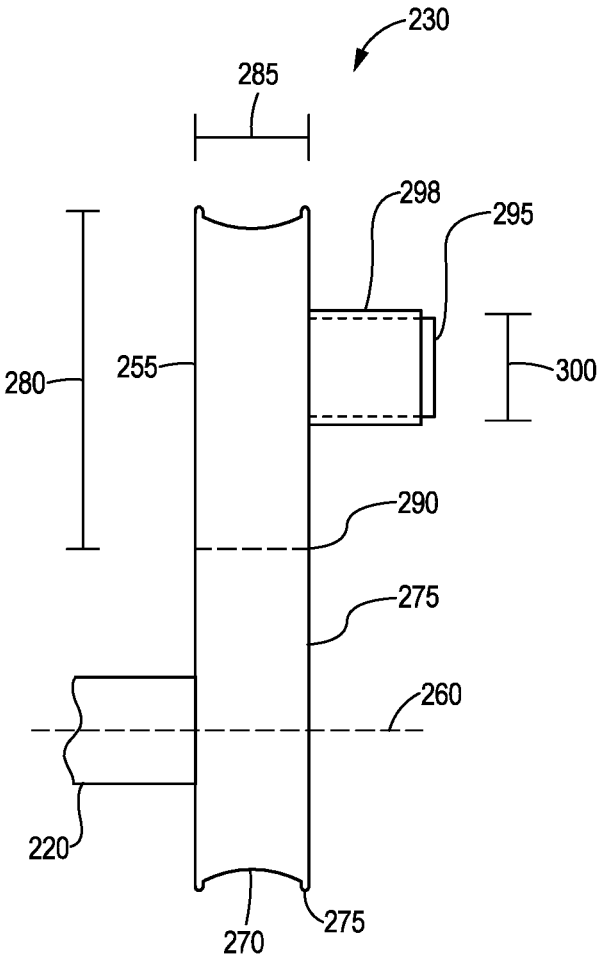
FIG. 4 is a side view of the cam of FIG. 3, according to one aspect of the present disclosure.

As shown in FIGS. 3 and 4, the cam 230 is cylindrical and mounted to the shaft 220 such that a center of rotation 260 is offset from a center of the circle 265, resulting in an eccentric rotation. Around a circumference of the cam is a cam contact surface 270. The contact surface 270 may be slight concave with a stabilization ridge 275 on the inner and outer edges. The cam 230 may have a radius 280 of between 1 and 1.5 meters and a thickness 285 of 0.5 to 0.65 meters. On an outer surface 290 of the cam 230, a cam post 295 extends away from the cam 230. The cam post 295 is positioned offset from the center of the circle 265 in an opposite direction to the shaft 220. The cam post 295 may extend 0.3-0.5 meters from the outer surface 290 of the cam 230. The cam post 295 includes a cam roller 298. The cam roller 298 fits on the cam post 295 and includes a set of bushings or other friction reducing means that allow the cam post 295 to roll within the cam roller 298. The cam roller 298 may have a circular cross-section with a diameter of 0.3-0.75 meters. In some other embodiments, the cam roller 298 may be a square with the dimensions across the flats of the square equal to the diameters for the circular cam roller 298.

Figure 5:
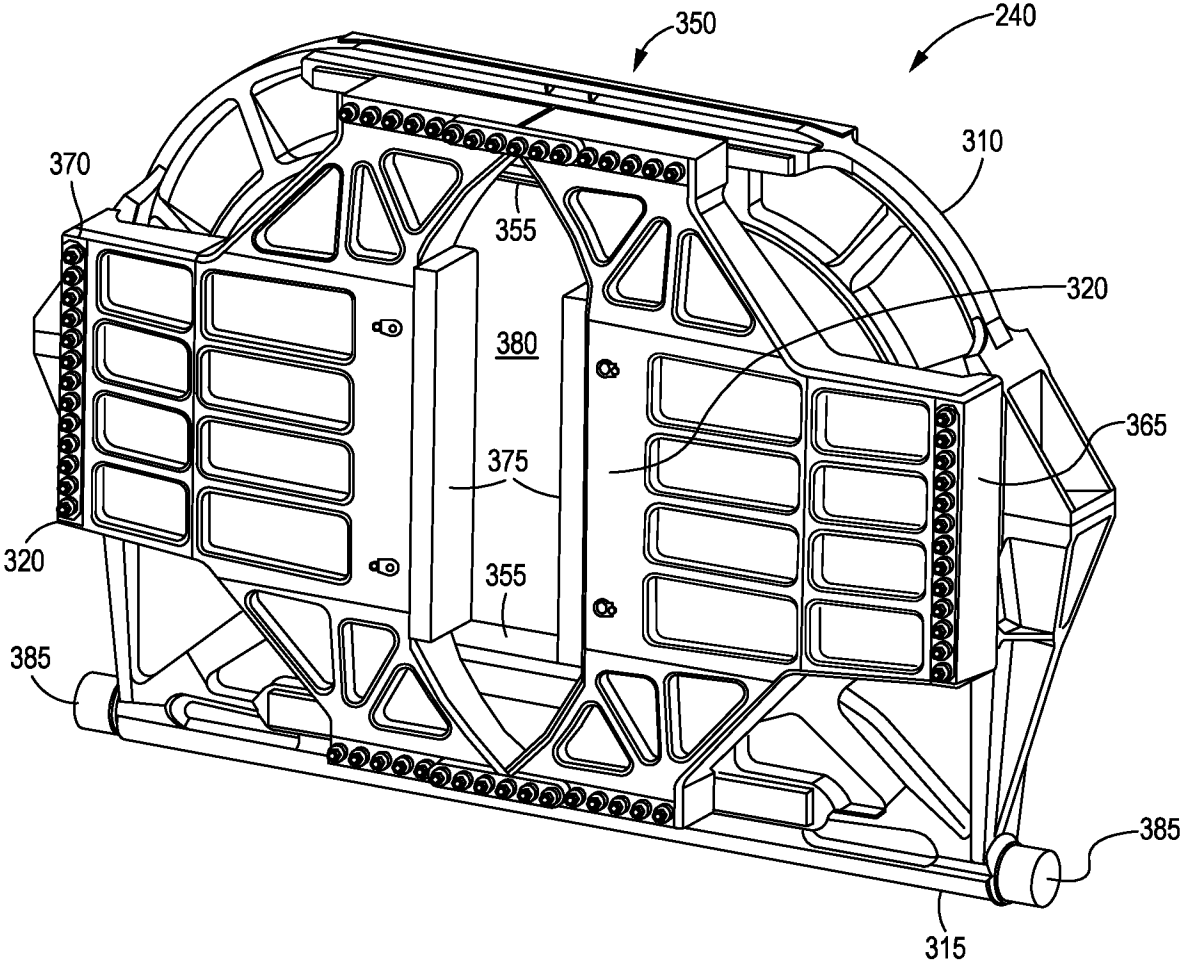
FIG. 5 is a perspective view of a cam frame assembly, according to one aspect of the present disclosure.
Figure 6:
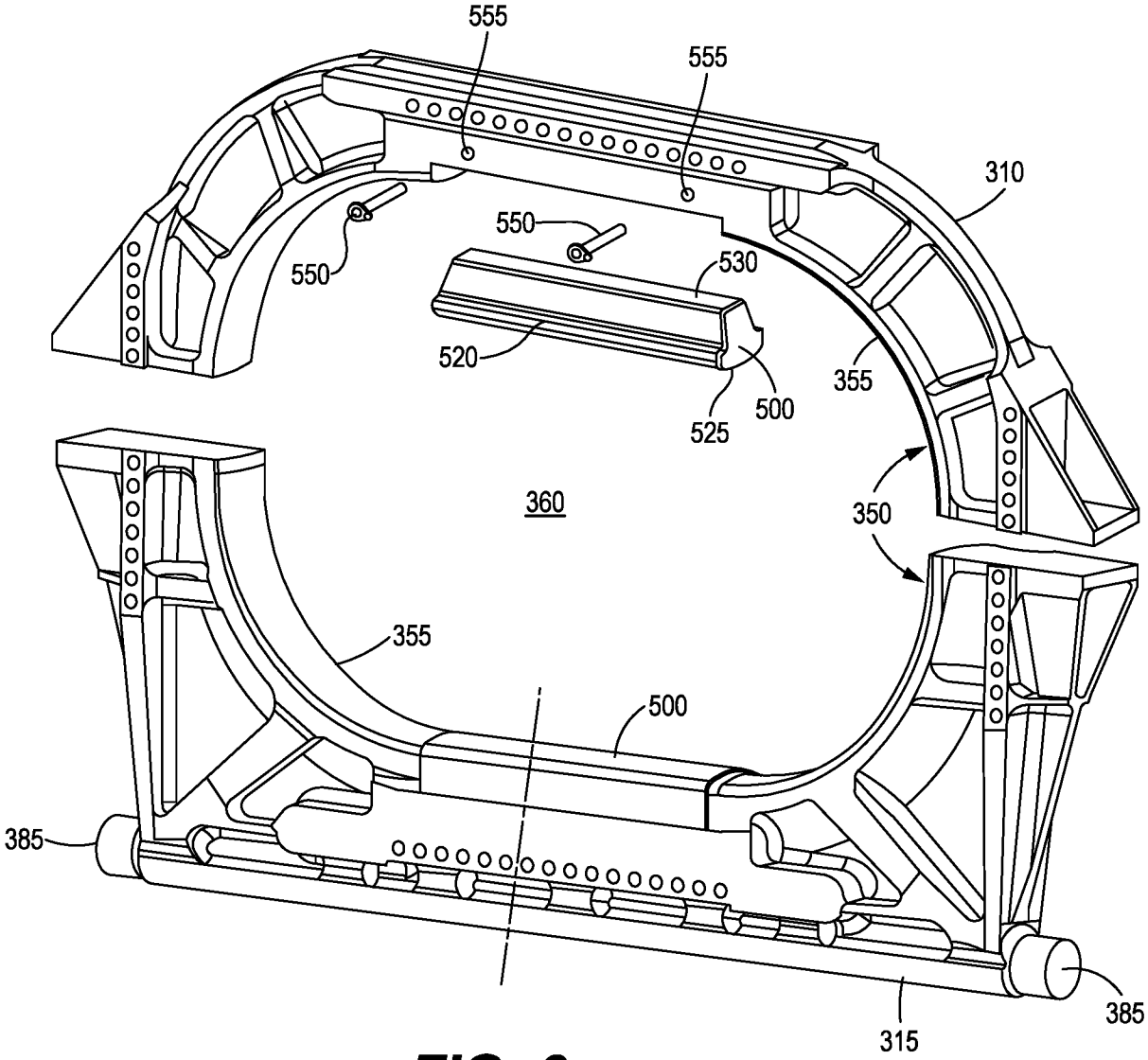
FIG. 6 is an exploded view of an upper and lower frame of the cam frame assembly of FIG. 4, according to one aspect of the present disclosure.
Figure 7:
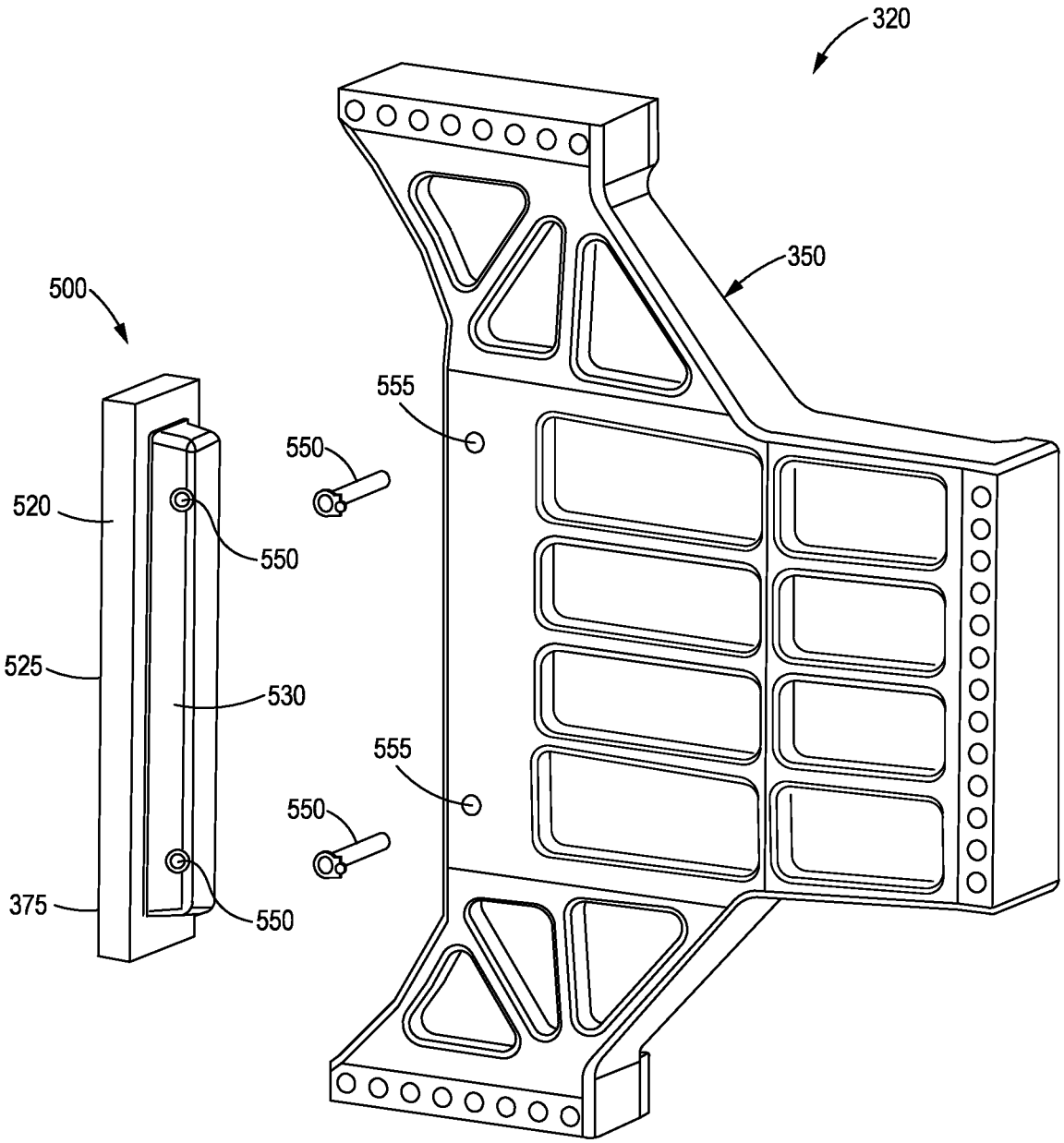
FIG. 7 is an exploded view of a guide frame of the cam frame assembly of FIG. 4, according to one aspect of the present disclosure.

The cam 230 rests within the cam frame assembly 240 such that the cam frame assembly 240 acts as a follower to the movement of the cam 230. The cam frame assembly 240 and its component parts are shown in FIGS. 5-7. FIG. 5 illustrates the frame assembly with all the pieces connected. Each cam frame assembly 240 includes an upper frame 310, a lower frame 315, and two guide frames 320. Collectively the component parts of the frame assembly 240 may be referred to as frame components 350.

FIG. 6 depicts the upper and lower frames in an exploded view. The upper frame 310 and the lower frame 315 are configured to surround and follow the movements of the cam 230. The upper frame 310 and the lower frame 315 each include a contact surface 355 which fits the contact surface 270 of the cam 230. When mounted together, the contact surfaces 270 of the upper 310 and lower frame 315 define an oval window 360. In some embodiments, the oval window 360 may have a width of 3 to 4 meters and a height between 1.5 and 2.5 meters, although the dimensions are dependent on the size of the cam.

A guide frame 320 is shown in FIG. 7. The guide frames 320 connect to the upper frame 310 and the lower frame 315. Each guide frame 320 overlaps both the upper 310 and lower frame 315 and about one half of the horizontal space. A front guide frame 365 is located nearer the front end 130 of the body 110 and a rear guide frame 370 is located further away from the front end 130. However, the two guide frames 320 are interchangeable with a 180 degree rotation. Each guide frame 320 has a contact surface 375 which crosses the oval window 360 when mounted to the frame assembly 240 as shown in FIG. 5. Together the contact surfaces 375 of each guide frame 320 define a vertical window 380 (see FIG. 5). The vertical window 380 is configured to fit the cam roller 298. In some embodiments, the vertical window 380 may be between 0.3 and 0.8 meter wide.

Each frame component 350 may be manufactured from a medium grade steel by forging or casting, although of course, other materials and manufacturing methods may be utilized.

The lower frame 315 connects to the shoe platform 250. In some embodiments, the lower frame 315 may be configured to sit within a recess (not shown) in the shoe platform 250 and connect to the shoe platform by a pair of posts 385 extending from each side of the frame, as shown in FIGS. 5 and 6. In some embodiments, the shoe platform 250 may be mounted on a swivel joint to accommodate variable ground conditions.

In some embodiments, the cam 230 and cam frame assembly 240 may be partly enclosed within a cover; in other embodiments, the cam 230 and frame assembly 240 may be visible on the outside of each side of the dragline 100 as illustrated in FIG. 1.

As the cam 230 is rotated by the shaft 220, the cam 230 moves around the oval window 360 of the upper and lower frames 310, 315 and the cam post 295 moves up and down along the vertical window 380 of the guide frames 320. This constrained movement lifts the shoe platform 250 and the rest of the dragline 100 in turn to create a walking motion. The movement of the dragline 100 created by the walking system 200 is shown as a diagram in FIGS. 8-11. The base assembly 105 and body 110 are condensed into one block 400 to more easily depict the movement. The shape of the frame components 350 are also simplified. The diagrams are not to scale.

Figure 8:
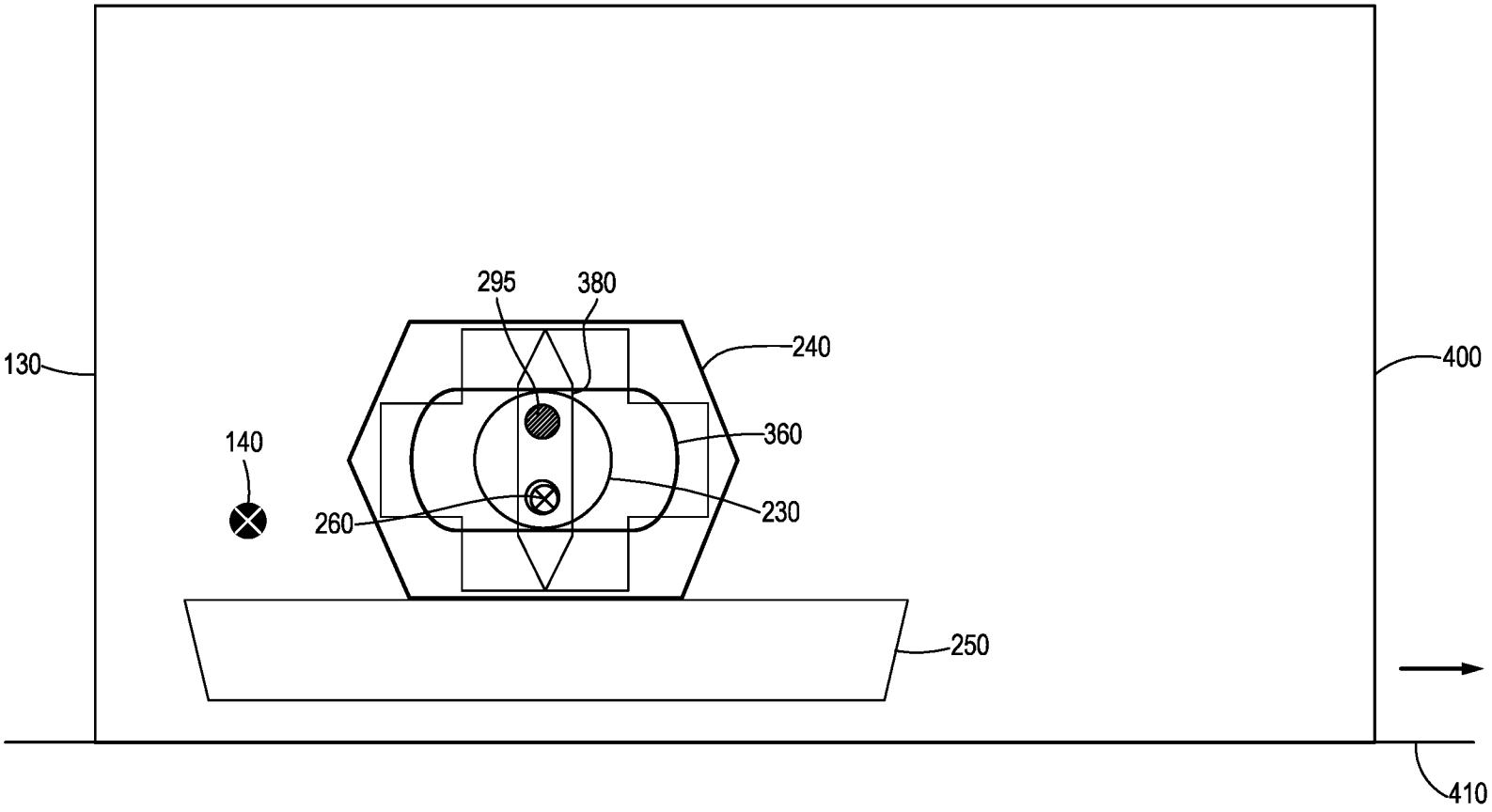
FIG. 8 is a diagram depicting one part of the walking process, according to one aspect of the present disclosure.
Figure 9:
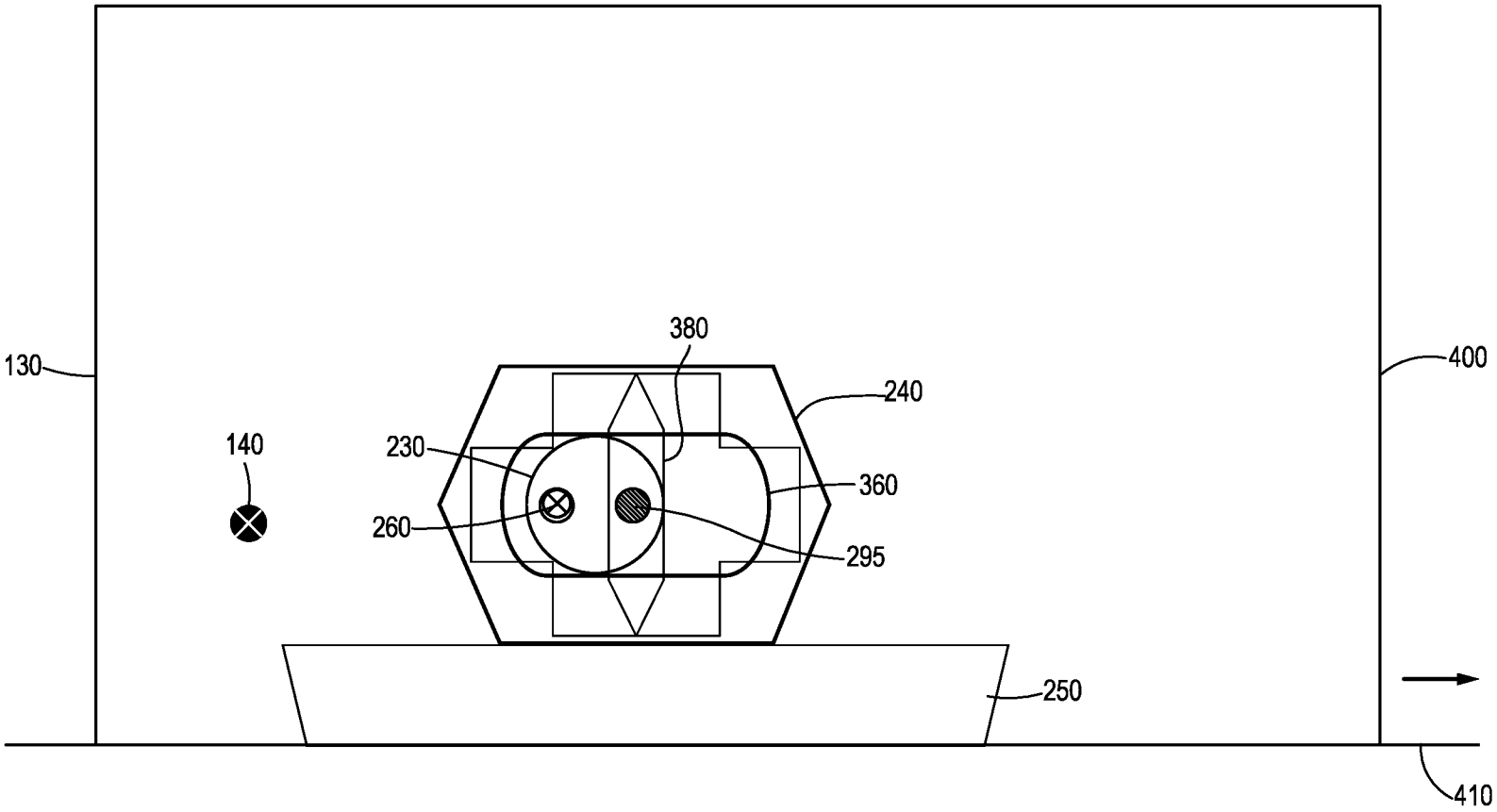
FIG. 9 is a diagram depicting one part of the walking process, according to one aspect of the present disclosure.
Figure 10:
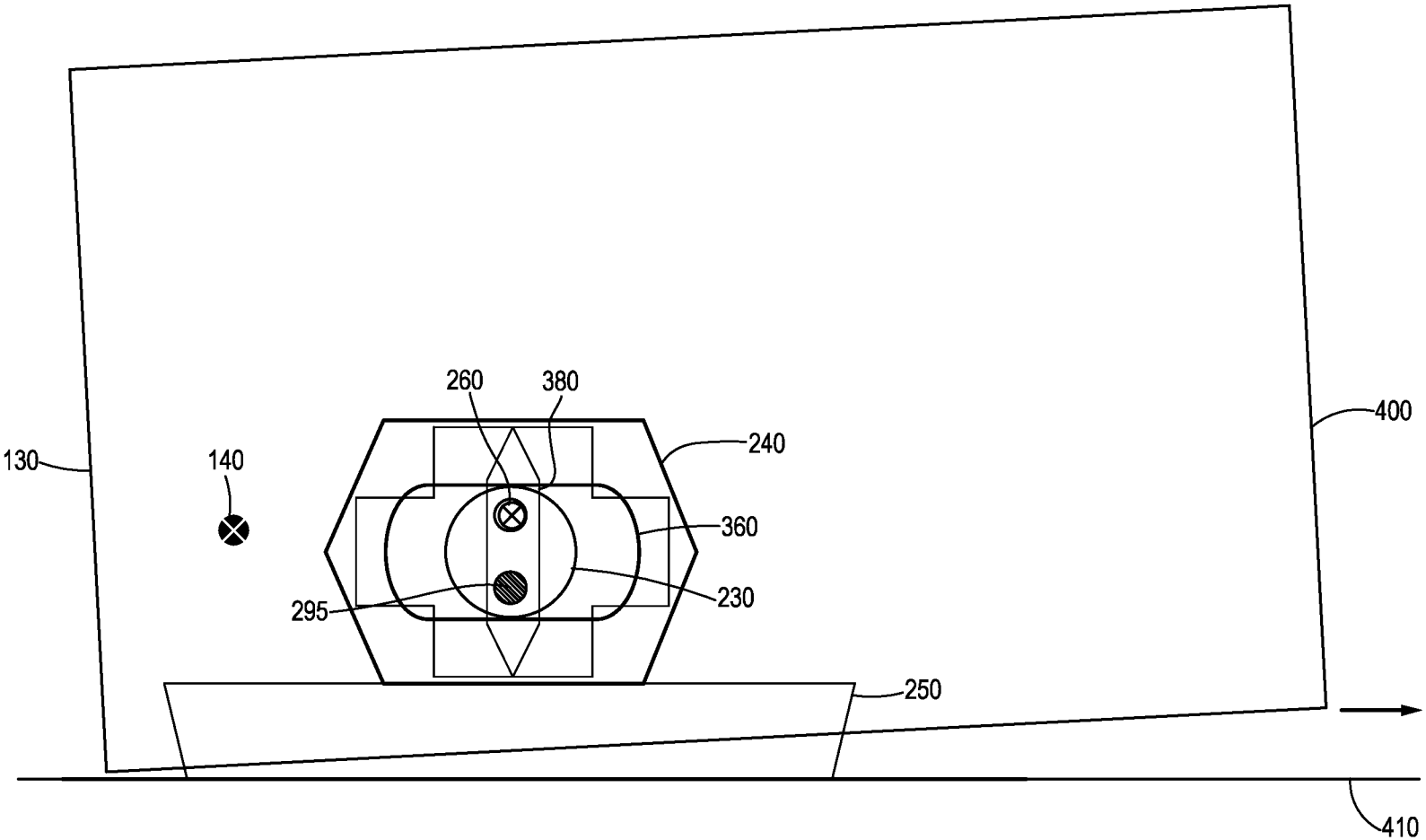
FIG. 10 is a diagram depicting one part of the walking process, according to one aspect of the present disclosure.
Figure 11:
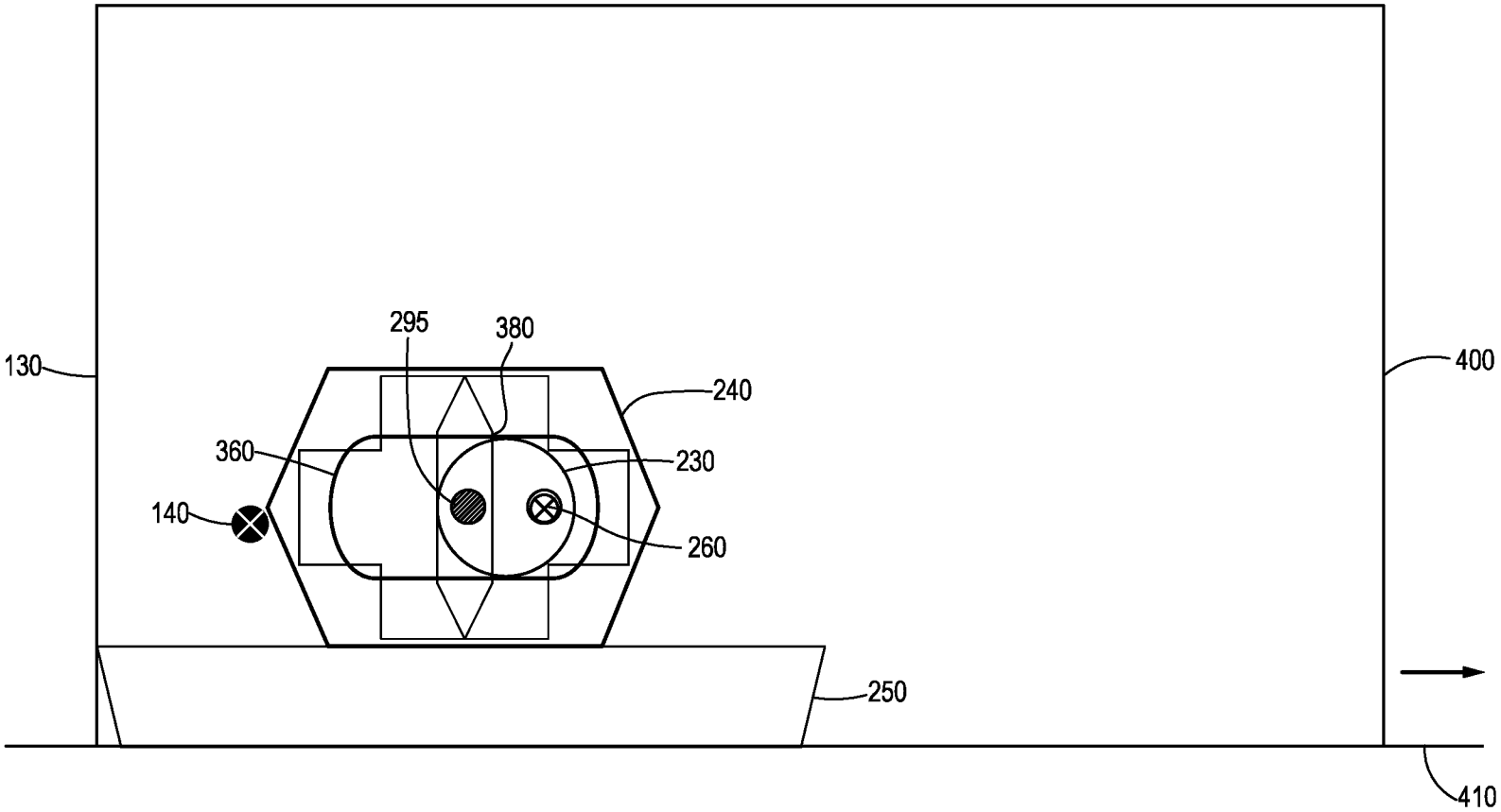
FIG. 11 is a diagram depicting one part of the walking process, according to one aspect of the present disclosure.

When the cam 230 is rotated such that the cam post 295 is at the top of the vertical window 380, the shoe platform 250 is in a raised position and the dragline block 400 rests on the ground, as shown in FIG. 8. As the shaft 220 rotates, the cam 230 rotates around its center of rotation 260. This pushes the frame assembly 240 and shoe platform 250 to the rear, the cam post 295 begins to lower between the guide frames 320, and the shoe platform 250 moves towards the rear of the dragline 100 and descends towards the ground. The shoe platform 250 contacts the ground when the cam post 295 and the rotation point 260 are in line horizontally, as shown in FIG. 9. With further rotation, the rotation of the shaft 220 pushes the frame assembly 240 down. The shoe platform 250 takes the weight of the dragline block 400 and the dragline 400 rises into the air. Because the center of mass of the dragline 400 is in front of the walking system, the dragline 400 tilts forward slightly, as shown in FIG. 10. Next, the dragline 100 is shifted backwards over the shoe platform and down to the ground (FIG. 11). Finally, the shoe platform is raised back up and the system is ready to take another step (FIG. 8).

The dragline 100 walks backwards away from the front end 130 of the body 110 and the boom assembly 115. Each step or full revolution of the cam 230 and shaft 220 may take a minute to complete. A single step may move the dragline 100 between 5 and 8 feet. The walking system 200 may be able to propel the dragline 100 over up to a 10% grade.

The movement of the cam 230 within the frame assembly 240 creates wear on the contact surfaces 355, 375 of the frame components 350. In particular, the contact surfaces 355, 375 of the lower frame 315 and the rear guide frame 370 are vulnerable to considerable wear damage as they take much of the load. This wear can affect the operation of the walking system 200. Accordingly, replaceable wear surfaces may be included in any or all of the frame components at these contact surfaces. A replaceable wear surface may be utilized in any number of frame components according to the needs of the machine.

As shown in FIGS. 5-7 and FIGS. 12-14, the replaceable wear surface is provided by an insert 500 which fits into a notch 510 in the corresponding frame component 350. The inserts 500 may be manufactured of a high-toughness wear-resistant steel.

Figure 12:
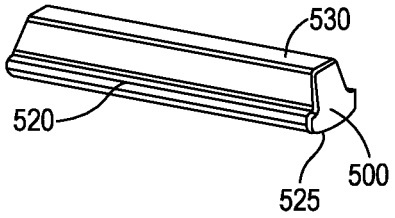
FIG. 12 is a perspective view of one embodiment of an insert, according to one aspect of the present disclosure.
Figure 13:
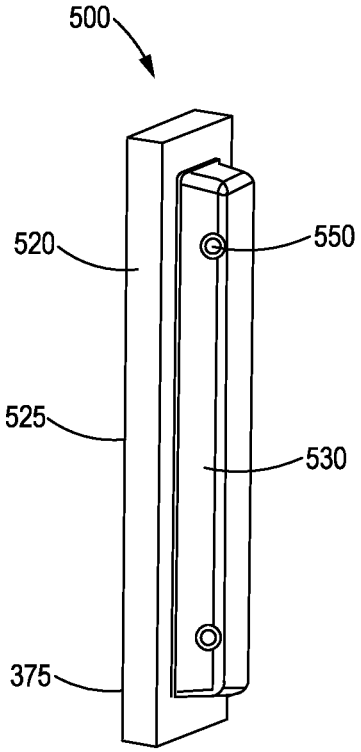
FIG. 13 is a perspective view of one embodiment of an insert, according to one aspect of the present disclosure.
Figure 14:
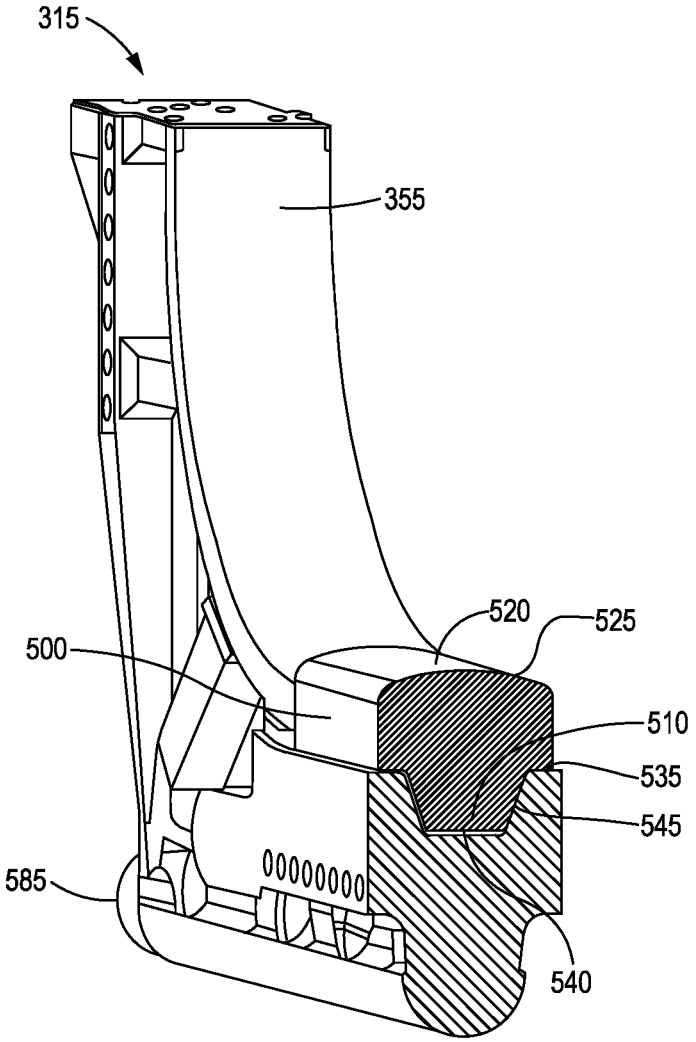
FIG. 14 is a cross section of the lower frame of FIG. 5 taken along line x, according to one aspect of the present disclosure.

Different possible embodiments of the insert 500 are shown in FIGS. 12 and 13, which may be suitable for different frame components 350. The insert 500 of FIG. 12 is configured to fit within the upper frame 310. The insert 500 of FIG. 13 is configured to fit within the guide frames 320. A cross-section of the notch 510 and insert 500 is shown in FIG. 14. The illustrated cross-section is of the lower frame 310, however, the cross-sections of the notch 510 in the other frame components 350 are substantially the same shape.

Each insert 500 has an outer portion 520 configured to provide a replacement contact surface 525 and a smaller inner portion 530 configured to fit tightly within the notch 510. The ends of the insert 500 may be flush with the ends of the notch 510 as shown in the upper frame insert 500 of FIGS. 6 and 12, or overlap past the notch 510 as shown in the guide frame insert 500 of FIGS. 7 and 13. The insert 500 for the guide frames 320 may be 1.5 meters to 2.2 meters long. The insert 500 for the upper frame 310 and the lower frame 315 may be 1.3 meters to 1.8 meters long.

In cross-section, the outer portion 520 of the insert 500 is wider than the inner portion 530. The outer portion 520 may be substantially rectangular, with a replacement contact surface 525 that is either flat or curved. The inner portion 530 may have at trapezoidal cross-section connected to the outer portion 520.

The notch 510 also has a trapezoidal cross-section to correspond to the inner portion 530 of the insert 500. The notch 510 does not extend the entire width of the frame component 350, leaving a flat surface 535 on each side of the notch 510. The base 510 of the notch 510 and the flat surfaces 535 either side of the notch 510 are configured to take the load of the cam 230 as it moves over that insert 500. In some embodiments, the angle (a) between a base 540 of the notch 510 and the angled surfaces 545 may be between 100 and 120 degrees. The base 540 of the notch 510 may be up to 50% of the width of the frame component 350. The notch 510 may be up to 160 mm deep. Of course, other dimensions may be used.

The notch 510 and the inner portion 530 of the insert 500 are configured to create a matching fit tight enough to hold the insert 500 in place. Gravity may also assist the fit in the lower frame 315. Retaining pins 550 may also be used to connect each insert to its frame component 350. The retaining pins 550, shown in FIGS. 6 and 7, may extend through a bore hole 555 in the frame component 350 and the inner portion 530 of the insert 500.

The inserts 500 may be replaced without complete disassembly of the cam frame assembly 240. For example, the inserts on the guide frames may be replaced as follows: With the cam 230 at top dead center, remove the cam roller 298. Restrain the shoe 250 from moving forward or rearward. Slowly rotate the cam 230 until the cam post 295 is touching the surface 525 of insert 500. Support the opposite insert 500, and remove the two retaining pins 550 if present. Remove the worn insert 500 and install the new insert. After changing the insert, 500 rotate the cam 230 until the cam post 295 is centered in the slot between the guide frames. Finally, replace the cam roller 298.

INDUSTRIAL APPLICABILITY

In general, the present disclosure finds application in the open mining industry. More specifically, the replaceable wear surfaces disclosed above may be advantageous for any oversized machine that utilizes a walking system 200. Further, older draglines 100 with walking systems 200 that do not include replaceable wear surfaces may replace any or all of the frame components 350 with a frame component 350 including the notch 510 described previously. As a result, the life of older machines may be extended by the use of these replaceable inserts 500.

Figure 15:
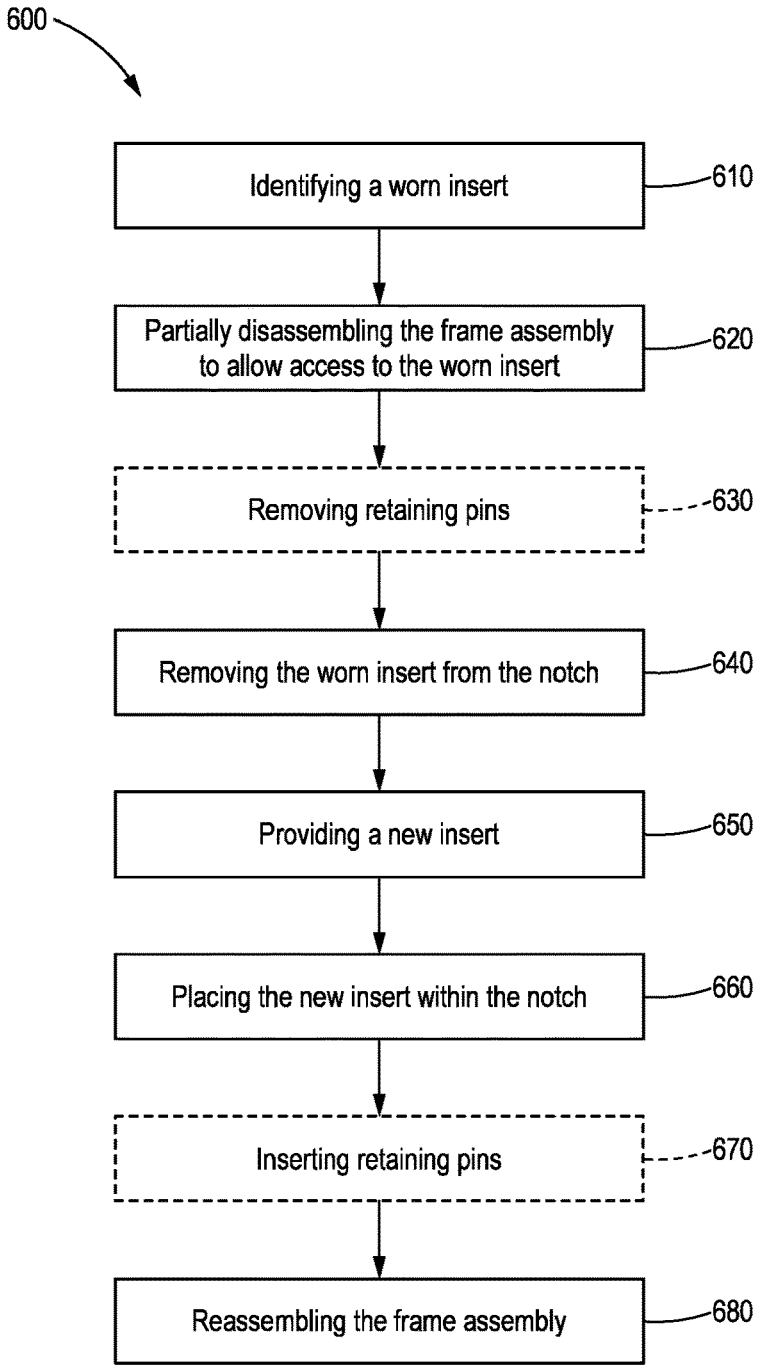
FIG. 15 is a method of replacing an insert, according to one aspect of the present disclosure.

A method for replacement of the inserts 500 is shown in FIG. 15, beginning in block 610.

First, a worn insert 500 is identified. An insert may be considered worn under a number of conditions, including but not limited to the following: the contact surface is pitted over more than 50% of the surface area, the surface condition causes severe vibration during walking, the insert is cracked, or the contact surface is worn in excess of 25 mm. Furthermore, the upper and lower inserts 500 should be replaced whenever a cam 230 is replaced.

The frame assembly 240 is then partly disassembled to access the worn insert 500, per block 620. Next, retaining pins 550 are removed, if present (block 630), and the worn insert 500 is removed from the notch 510 (640).

A new insert 500 is provided and placed within the notch 510, as shown in blocks 650 and 660. The retaining pins 550 are inserted, if required (block 670). Finally, the frame assembly 240 is reassembled, per block 680.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A cam frame assembly for a dragline walking system, configured to surround a cam and a cam post, comprising:

a plurality of frame components, the frame components including
an upper frame;
a lower frame;
a front guide frame; and
a rear guide frame;
at least one of the plurality of frame components having a replaceable wear surface, the replaceable wear surface being an insert retained within a notch in the at least one of the plurality of frame components.

2. The frame assembly of claim 1, wherein the notch has a trapezoidal cross section.

3. The frame assembly of claim 1, wherein the insert has an outer portion, an inner portion with a trapezoidal cross section, and a contact surface on the outer portion.

4. The frame assembly of claim 3, wherein the contact surface is curved.

5. The frame assembly of claim 3, wherein the contact surface is flat.

6. The frame assembly of claim 1, wherein the insert is held within the notch by a plurality of retaining pins.

7. The frame assembly of claim 1, wherein an outer portion of the insert is longer than the notch.

8. A walking system for a dragline, comprising:
a motor;
a shaft driven by the motor;
an eccentric cam mounted to the shaft on a first side and having a cam post and extending from a second side, the cam post having a roller;
a cam frame assembly configured to follow the cam, the cam frame assembly having a plurality of frame components, at least one of the plurality of frame components having a trapezoidal notch and an insert configured to fit within the notch; and
a shoe platform attached to the cam frame assembly.

9. The system of claim 8, wherein the plurality of frame components includes a lower frame, an upper frame, a rear guide frame, and a front guide frame, the plurality of frame components configured to surround the cam and the cam post.

10. The system of claim 8, wherein the insert has an outer portion, an inner portion with a trapezoidal cross section, and a contact surface on the outer portion.

11. The system of claim 10, wherein the contact surface is curved.

12. The system of claim 8, wherein the insert is held within the notch by a plurality of retaining pins.

13. The system of claim 8, wherein an outer portion of the insert is longer than the notch.

14. A dragline, comprising:
a body;
a base assembly supporting the body;
a boom assembly supported by the body;
a bucket assembly supported by the boom assembly; and
a walking system duplicated on each side of the dragline, and configured to move the dragline, the walking system having:
a motor,
a shaft driven by the motor and extending into the body,
an eccentric cam mounted to the shaft on an inner surface of the cam, the cam having a cam post with a roller extending from an outer surface of the cam, and
a cam frame assembly configured to follow the cam, the cam frame assembly having a plurality of frame components, at least one of the plurality of frame components having a replaceable wear surface.

15. The dragline of claim 14, wherein the replaceable wear surface is an insert retained within a trapezoidal notch in the frame component.

16. The dragline of claim 14, wherein the plurality of frame components includes a lower frame, an upper frame, a rear guide frame, and a front guide frame, the plurality of frame components configured to surround the cam and the cam post.

17. The dragline of claim 16, wherein the lower frame includes a notch and an insert.

18. The dragline of claim 14, wherein the insert has an outer portion, an inner portion with a trapezoidal cross section, and a contact surface on the outer portion.

19. The dragline of claim 18, wherein the contact surface is curved.

20. The dragline of claim 14, wherein the insert is held within the notch by a plurality of retaining pins.

* * * * *